US007722337B2

(12) United States Patent
Nommensen et al.

(10) Patent No.: US 7,722,337 B2
(45) Date of Patent: May 25, 2010

(54) PISTON COMPRESSOR CYLINDER ARRANGEMENT, PARTICULARLY FOR A HERMETICALLY ENCLOSED REFRIGERANT COMPRESSOR

(75) Inventors: Marten Nommensen, Flensburg (DE); Frank Holm Iversen, Padborg (DK); Heinz Otto Lassen, Flensburg (DE); Beate Sönksen, Hattstedt (DE)

(73) Assignee: Danfoss Compressors GmbH, Flensburg (DE)

( * ) Notice: Subject to any disclaimer, the term of this patent is extended or adjusted under 35 U.S.C. 154(b) by 673 days.

(21) Appl. No.: 11/253,189

(22) Filed: Oct. 17, 2005

(65) Prior Publication Data

US 2006/0133943 A1 Jun. 22, 2006

(30) Foreign Application Priority Data

Oct. 18, 2004 (DE) ..... 10 2004 050 844

(51) Int. Cl.
*F04B 17/00* (2006.01)

(52) U.S. Cl. ..... 417/415; 417/372

(58) Field of Classification Search ..... 417/254, 417/312, 360, 372, 415, 902; 92/72, 73, 92/140, 188; 428/36.9; 441/1; 220/560, 220/737, 739, 62.18, 592.27, 592.2; 29/511, 29/516; 188/267
See application file for complete search history.

(56) References Cited

U.S. PATENT DOCUMENTS 1,285,430 A * 11/1918 Sheppy ..... 123/41.84
2,238,404 A * 4/1941 Spencer ..... 123/41.83
2,563,348 A * 8/1951 Lyman ..... 123/193.3
2,584,518 A * 2/1952 Walton ..... 92/171.1
3,039,677 A * 6/1962 Nissley ..... 184/6
3,465,954 A * 9/1969 Ellis ..... 417/363
3,600,111 A * 8/1971 Rogers ..... 417/312
3,674,147 A * 7/1972 Danti ..... 210/136
4,127,994 A * 12/1978 Niven ..... 62/469
4,370,104 A * 1/1983 Nelson et al. ..... 417/312
4,396,848 A * 8/1983 Scheldorf et al. ..... 310/54
4,544,334 A * 10/1985 Ellis ..... 417/360
4,968,222 A * 11/1990 Gotou et al. ..... 417/313
5,011,382 A * 4/1991 Thompson ..... 417/571
5,046,929 A * 9/1991 Novotny et al. ..... 417/439
5,467,891 A * 11/1995 Perry ..... 220/739
5,562,786 A * 10/1996 Hayashi et al. ..... 148/579
5,676,533 A * 10/1997 Park et al. ..... 417/569
5,769,126 A * 6/1998 Cho ..... 137/856

(Continued)

FOREIGN PATENT DOCUMENTS

DE 3901588 7/1990

(Continued)

*Primary Examiner*—Devon C Kramer
*Assistant Examiner*—Amene S Bayou
(74) *Attorney, Agent, or Firm*—McCormick, Paulding & Huber LLP

(57) ABSTRACT

The invention concerns a piston compressor cylinder arrangement (1), particularly for a hermetically enclosed refrigerant compressor, with a cylinder body (2) and a cylinder head arrangement (7), the cylinder body (2) having a first front side (6) in the area of the cylinder head arrangement (7) and a second front side (8) at the other end. It is endeavoured to manufacture such a cylinder arrangement in a cost-effective manner without having to fear for a deformation during mounting. For this purpose, a cup-shaped mounting sleeve (9) surrounds the cylinder body (2) over its full axial working length with a radial distance on all sides.

21 Claims, 3 Drawing Sheets

U.S. PATENT DOCUMENTS

| | | | | |
|---|---|---|---|---|
| 5,909,749 | A * | 6/1999 | Lee et al. | 137/857 |
| 6,065,572 | A * | 5/2000 | Schober et al. | 188/267 |
| 6,095,768 | A * | 8/2000 | Bianchi | 417/415 |
| 6,109,518 | A * | 8/2000 | Mueller et al. | 229/403 |
| 6,358,019 | B1 * | 3/2002 | Iversen et al. | 417/312 |
| 7,134,847 | B2 * | 11/2006 | Nishihara et al. | 417/312 |
| 2001/0050198 | A1 * | 12/2001 | An et al. | 181/403 |
| 2003/0138336 | A1 * | 7/2003 | Nakane et al. | 417/540 |
| 2004/0052666 | A1 * | 3/2004 | Cho | 417/569 |
| 2005/0123411 | A1 * | 6/2005 | Petersen et al. | 417/254 |

FOREIGN PATENT DOCUMENTS

| | | |
|---|---|---|
| DE | 19903025 | 8/2000 |
| EP | 0 524 552 A1 | 7/1992 |
| EP | 0 507 091 A1 | 10/1992 |

* cited by examiner

PISTON COMPRESSOR CYLINDER ARRANGEMENT, PARTICULARLY FOR A HERMETICALLY ENCLOSED REFRIGERANT COMPRESSOR

CROSS-REFERENCE TO RELATED APPLICATIONS

Applicant hereby claims foreign priority benefits under U.S.C. §119 from German Patent Application No. 10 2004 050 844.5 filed on Oct. 18, 2004, the contents of which are incorporated by reference herein.

FIELD OF THE INVENTION

The invention concerns a piston compressor cylinder arrangement, particularly for a hermetically enclosed refrigerant compressor, with a cylinder body and a cylinder head arrangement, the cylinder body having a first front side in the area of the cylinder head arrangement and a second front side at the other end.

BACKGROUND OF THE INVENTION

Such a cylinder arrangement is, for example, known from DE 39 01 588 A1. In the area of its first end, the cylinder body has a circumferential projection. An edged mounting ring engages this projection and the cylinder head arrangement.

U.S. Pat. No. 6,095,768 discloses a further, similar refrigerant compressor. The cylinder body has a cylinder pipe, which is provided with two axially protruding ribs over its full axial length. By means of these two ribs, the cylinder body is welded onto a mounting rail of the compressor block.

EP 0 524 552 A2 shows a similar embodiment, in which a cylinder is located on a housing part, the cylinder having in the area of its first front side a radially extended flange, on which a valve plate is fixed.

EP 0 507 091 B1 shows a cylinder pipe, which is guided through and connected with a block-like housing.

Large numbers of refrigerant compressors are used in refrigeration appliances, that is, refrigerators, freezers or vending machines. Here, it is endeavoured to achieve the best possible efficiency. In order to achieve a good mechanical efficiency, it is required that a piston reciprocating in a cylinder formed inside the cylinder body fits as exactly into this cylinder as possible. Accordingly, the tolerances have to be small.

At the same time, it is desired to make the production of such refrigerant compressors as cost-efficient as possible. The more cost-effective the manufacturing process is, the larger is the risk that narrow tolerances will not be observed. Particularly, there is a risk that the cylinder body is deformed and then no longer "fits" with the piston.

BRIEF SUMMARY OF THE INVENTION

The invention is based on the task of mounting a cylinder body in a cost-effective manner without deforming it.

With a piston compressor cylinder arrangement as mentioned in the introduction, this task is solved in that a cup-shaped mounting sleeve surrounds the cylinder body over its full axial working length with a radial distance on all sides.

Now, the complete cylinder arrangement can be mounted in the piston compressor without forces having to act upon the circumference of the cylinder body. The forces required for holding the cylinder body are completely adopted by the mounting sleeve. These forces are not passed on to the circumference of the cylinder body, so that a deformation of the cylinder body in the radial direction must not be feared. The choice of fixing means for the mounting sleeve in the piston compressor is relatively free. The mounting sleeve can also be fixed in the piston compressor by welding, without risking that resulting thermal stresses will influence the cylinder body. Further, in a manner of speaking, the mounting sleeve makes it possible to pre-manufacture the cylinder arrangement, that is, to form it as a cartridge, which contains the cylinder body and the cylinder head arrangement. Also this makes the manufacturing cost-effective, without causing compromises with regard to the accuracy of the parts used.

Preferably, an annular gap, which is through-going in the circumferential and axial directions, is formed between the radial outside of the cylinder body and the radial inside of the mounting sleeve. This annular gap then contains no elements, which could transfer forces acting upon the mounting sleeve from the outside to the cylinder body. On the contrary, deformations of the mounting sleeve are permitted to a certain extent, such deformations having no effect on the cylinder body.

Preferably, the annular gap has an extension, which as a maximum corresponds to the radial thickness of the cylinder body plus the radial thickness of the mounting sleeve, particularly as a maximum the radial thickness of the cylinder body and particularly preferred as a maximum the radial thickness of the mounting sleeve. Thus, in the radial direction the annular gap can be relatively small. This saves space. The "cartridge" does not require substantially more space than the cylinder body alone.

Preferably, a radially inwardly protruding end section of the mounting sleeve bears on the second front side of the cylinder body. Thus, in the area of the second front side the mounting sleeve acts directly upon the cylinder body and retains it. The forces of the end section acting upon the cylinder body only act in the axial direction. In the axial direction, however, the cylinder body is stable enough to adopt these forces without being deformed.

It is preferred that the end section is also deformed axially inwards. Thus, this end section has a spring effect, that is, the mounting sleeve can be mounted on the cylinder body with a certain prestress.

Preferably, the outside of the second cylinder body front side has a circumferential recess, in which the mounting sleeve end section engages. This has the advantage that the mounting sleeve and the cylinder can be centred in relation to each other. In the area of this recess radial forces can then act upon the cylinder body. As, however, this position lies outside the working length of the cylinder body, deformations, if any, will no longer have an effect on the tightness between piston and cylinder.

Preferably, the radial inside of the recess is bordered by a conically shaped wall. Thus, the mounting is easier. When the cylinder body is inserted in the mounting sleeve, it centers, in a manner of speaking, automatically.

Preferably, the mounting sleeve is a deep-drawn sheet metal part. A deep-drawn sheet metal moulding has a sufficient stability. Within certain limits, deep-drawing the mounting sleeves from a sheet metal plate gives a large shaping freedom. Further, a deep-drawn sheet metal part is relatively cost-effective. The material, that is, the sheet metal plate, is cheaper than a corresponding pipe. The deep-drawing process in itself does not contribute substantially to an increase of the costs.

Preferably, the cylinder body is a sintered part. A sintered part can be manufactured with a high accuracy, so that the inner diameter corresponds with very small tolerances with the desired specifications. With the accuracies achieved, piston rings can, under certain circumstances, even be avoided.

Preferably, the sintered part is treated to be gas-tight, particularly steam-cured. This reduces the gas permeability of the sintered part. "Gas-tight" is not to be understood as absolute gas tightness. The treatment, particularly the steam curing, of the sintered part, however, reduces the gas permeability of the cylinder body so much that the efficiency is practically not deteriorated.

Preferably, the first cylinder body front side has a recess, into which a projection arrangement formed on the cylinder head arrangement engages. Thus, it is possible to align the cylinder body and the cylinder head arrangement in relation to each other in the radial direction. Later, this will improve the efficiency, particularly in that the position of the valves, particularly the pressure valves, can now be better fixed in relation to the cylinder.

Preferably, the recess is made to be circumferential. This simplifies the mounting. It no longer has to be ensured that the cylinder body and the cylinder head arrangement are aligned at a predetermined angular position in relation to each other.

It is preferred that the projection arrangement has several circumferentially distributed projections, which are separated from each other by interstices. This is particularly advantageous, when somehow the cylinder head arrangement is acted upon thermally during mounting, for example by welding. In this case, distortions, which are caused by irregular temperature distributions, are always limited to predetermined circumference sections. Further, the interstices can be used for the angular positioning of the individual cylinder head arrangement components.

Preferably, the mounting sleeve is fixedly connected with the cylinder head arrangement. Such a connection can, for example, be made by welding. With the connection of mounting sleeve and cylinder head arrangement, the cylinder arrangement is, in a manner of speaking, finished, that is, a cartridge is available, which can be handled in one piece and be used when mounting the piston compressor.

It is advantageous that the mounting sleeve is connected with a circumferential face of the cylinder head arrangement. Thus, the cylinder body is positioned in the mounting sleeve and the cylinder head arrangement is mounted. The cylinder head arrangement projects slightly into the mounting sleeve. If required, the cylinder head arrangement can further be pressed against the cylinder body, thus deforming the bordered end section of the mounting sleeve. When then the mounting sleeve is fixed on the circumferential wall of the cylinder head arrangement, small displacements, which occur because of manufacturing inaccuracies, can be compensated.

Preferably, the cylinder head arrangement has a base plate, which has on the side facing the cylinder body a pressure valve plate and adjacently a suction valve plate, the pressure valve plate forming a valve seat for at least one suction valve and the suction valve plate forming a valve seat for at least one pressure valve. As the pressure valve plate and the suction valve plate can be made substantially thinner than the base plate, this will keep dead spaces small. Thus, the efficiency of the compressor is further improved.

Preferably, a pressure muffler is located on the side of the base plate facing away from the cylinder body, the pressure muffler being connected with the base plate by means of welding. A pressure muffler has a muffling volume, which is connected with the outlet of the pressure valves. When, now, this pressure muffler is fixedly connected with the cylinder head arrangement, the mounting between the pressure muffler and the cylinder head arrangement can also be made in advance, which is a further substantial simplification of the mounting.

It is preferred that the pressure muffler has a bottom part, which is welded onto the base plate and a top part, which is welded onto the bottom part. This simplifies the connection of the pressure muffler and the cylinder head arrangement. The top part and the bottom part surround the mentioned muffling volume.

BRIEF DESCRIPTION OF THE DRAWINGS

In the following, the invention is described by way of a preferred embodiment in connection with the drawings, showing.

DETAILED DESCRIPTION OF THE INVENTION

Figure 1:
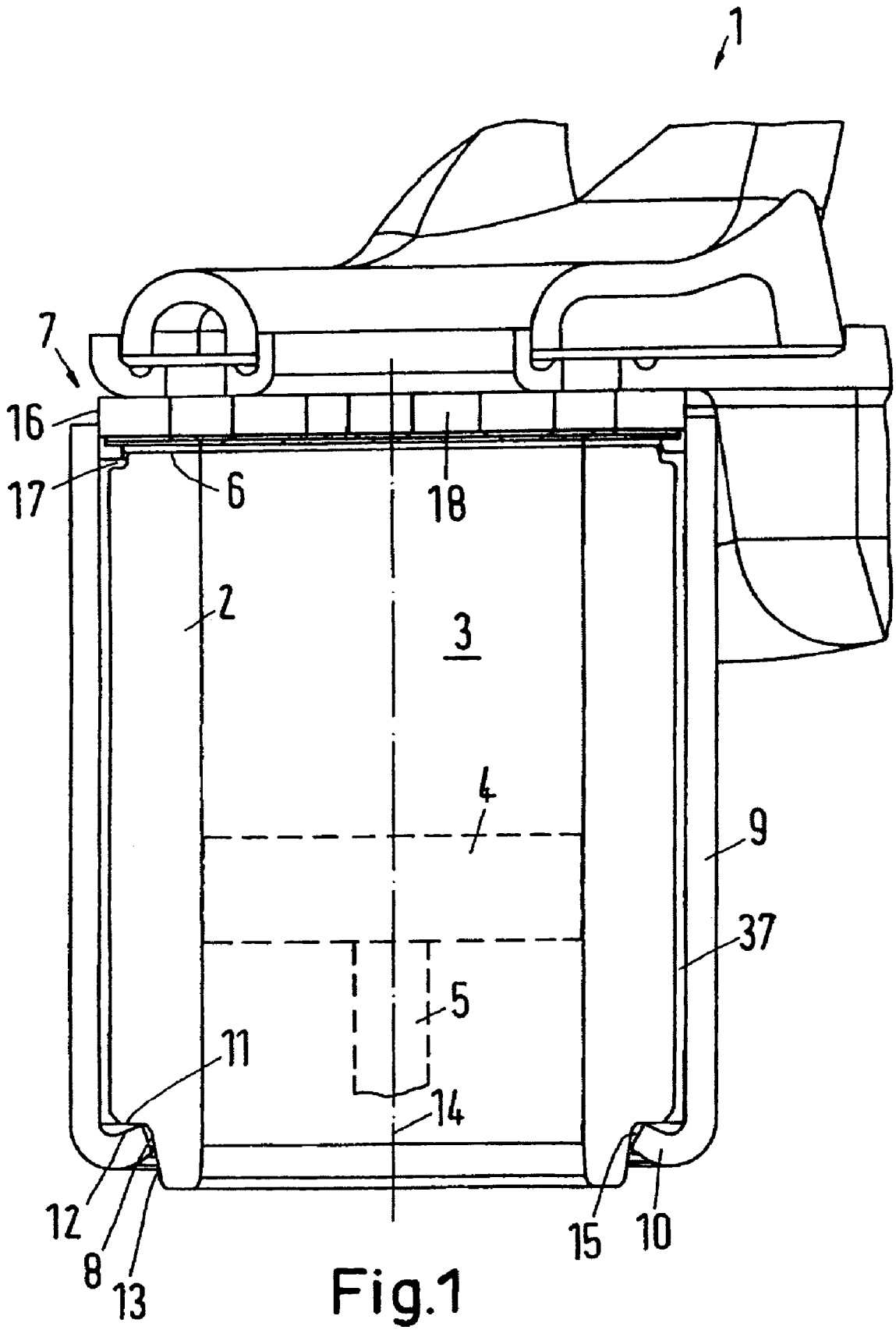
FIG. 1 is a schematic longitudinal section through a cylinder arrangement.

FIG. 1 shows a cylinder arrangement 1 of a refrigerant compressor, which is not shown in detail. The cylinder arrangement 1 has a cylinder body 2, which surrounds a cylinder chamber 3, in which a merely schematically shown piston 4 reciprocates to compress a refrigerant, which is located in the cylinder chamber 3. The piston 4 is driven by a connecting rod 5.

The cylinder body 2 is made of a sintered material, which is steam cured to be gas-tight.

The cylinder body 2 has a first front side 6, which bears on a cylinder head arrangement 7. Further, cylinder body 2 has a second front side 8, on which the cylinder chamber 3 is open.

In the circumferential direction, the cylinder body 2 is completely surrounded by a mounting sleeve 9, which also surrounds the largest share of the length of the cylinder body 2. The mounting sleeve 9 extends in the axial direction over at least the so-called "working length" of the cylinder body 2, that is, the length, in which the piston 4 moves.

Between the mounting sleeve 9 and the cylinder body 2 is formed an annular gap 37, which can be relatively thin. In the present embodiment, it is substantially thinner than the wall thickness of the mounting sleeve 9. It should as a maximum be as thick as the sum of the wall thicknesses of the cylinder body 2 and the mounting sleeve 9. The annular gap 37 merely has to be so thick that it does not pass on deformations of the mounting sleeve, which occur during fixing of the mounting sleeve in a refrigerant compressor, to the circumferential face of the cylinder body 2.

In the area of the second front side of the cylinder body 2, the mounting sleeve 9 has an end section 10, which is bent both radially and axially inwards. This end section 10 bears on the second front side 8 of the cylinder body 2, or rather on the bottom 11 of a recess 12. The radial inside of the recess 12 is formed by a slightly conically extending wall 13, that is, with an axis 14 of the cylinder chamber 3, the wall 13 encloses an acute angle. This embodiment causes that the mounting sleeve 9 is centred in relation to the cylinder body 2, when the cylinder body 2 is inserted in the mounting sleeve 9 and projects through an opening 15 from the mounting sleeve 9 with its second front side 8.

In the area of the first front side 6, the mounting sleeve 9 is connected with the cylinder head arrangement 7, that is, with the circumferential face 16 of the cylinder head arrangement 7. The connection can, for example, be made by means of welding. The welding can be made on the full circumference of the mounting sleeve 9 or it can be made as a spot-welding.

Before fixing the mounting sleeve 9 on the cylinder head arrangement 7, the cylinder head arrangement 7 is exposed to a certain pressure, so that the cylinder head arrangement 7 presses the cylinder body 2 firmly against the end section 10 of the mounting sleeve 9. As the end section 10 is bent slightly axially inwards, it forms some sort of spring. After connecting the mounting sleeve 9 with the cylinder head arrangement 7, the cylinder body 2 remains fixed between the end section 10 and the cylinder head arrangement 7, the forces acting upon the cylinder body 2 acting practically exclusively in the axial direction.

Figure 2:
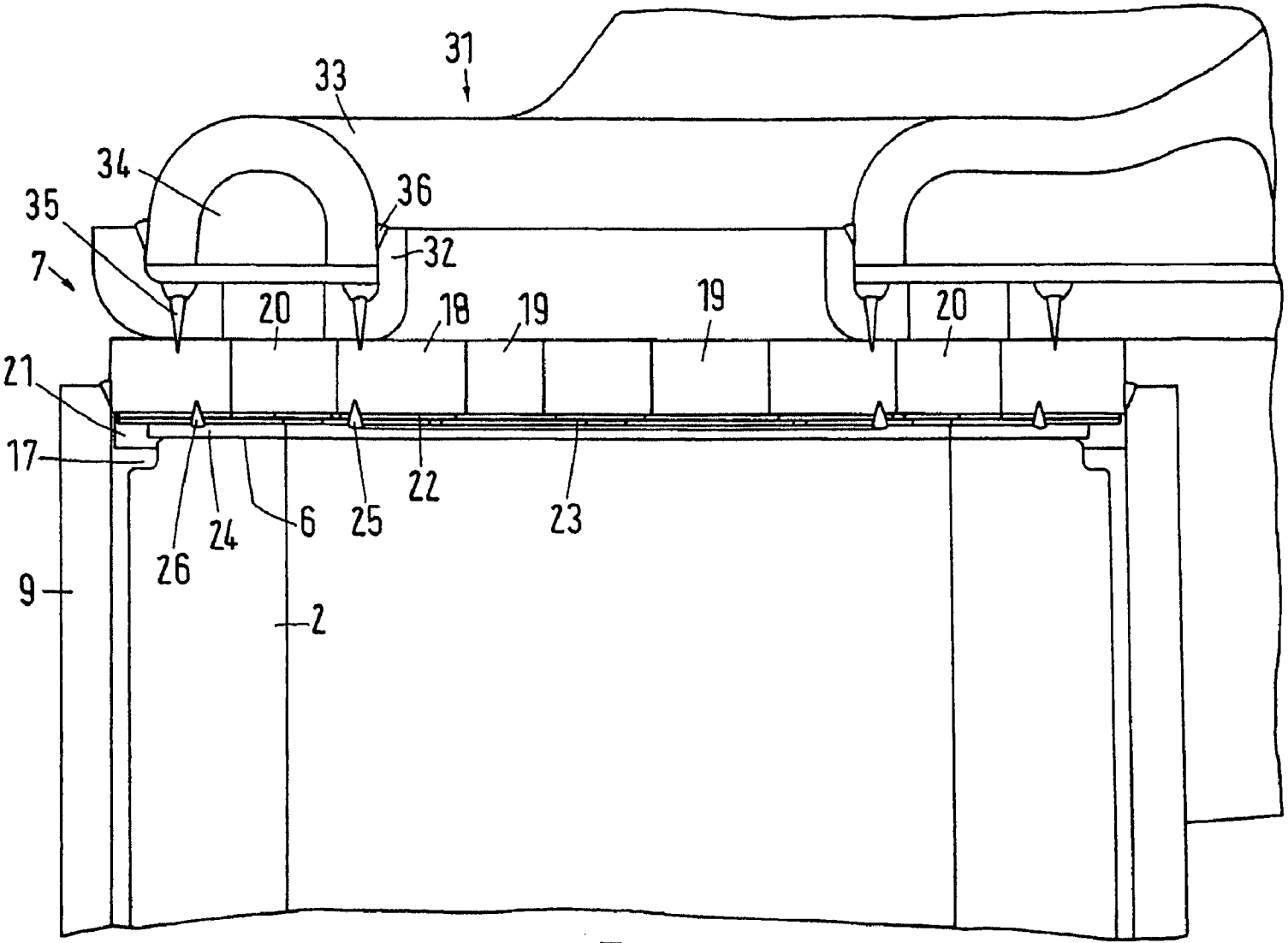
FIG. 2 is an enlarged view of the cylinder arrangement in the area of the cylinder head.

FIG. 2 now shows the cylinder head arrangement and the neighbouring area of the cylinder body 2 in a somewhat enlarged view.

In the area of its first front side 6, the cylinder body 2 has a circumferential recess 17. This recess 17 originates from the first front side 6 and the circumferential face of the cylinder body 2.

The cylinder body arrangement 7 has a base plate 18 with several suction openings 19 and several pressure openings 20. On the side facing the cylinder body 2, the base plate has several projections 21 distributed in the circumferential direction, said projections engaging the recess 17. The interaction between the projections 21 and the recess 17 aligns the cylinder body 2 in relation to the base plate 18.

A pressure valve plate 22 and a suction valve plate 23 are located between the base plate 18 and the cylinder body 2. Via a sealing 24, the suction valve plate 23 bears on the first front side 6 of the cylinder body 2. The suction valve plate 23, the pressure valve plate 22 and the base plate 18 are connected with each other by means of annular welding seams 25, which penetrate the suction valve plate 23 and the pressure valve plate 22. Here, the radially inner welding seam 25 seals a suction area located further radially inwards against a pressure area located further radially outwards. The welding seam 26 seals the pressure area radially outwards.

Figure 3:
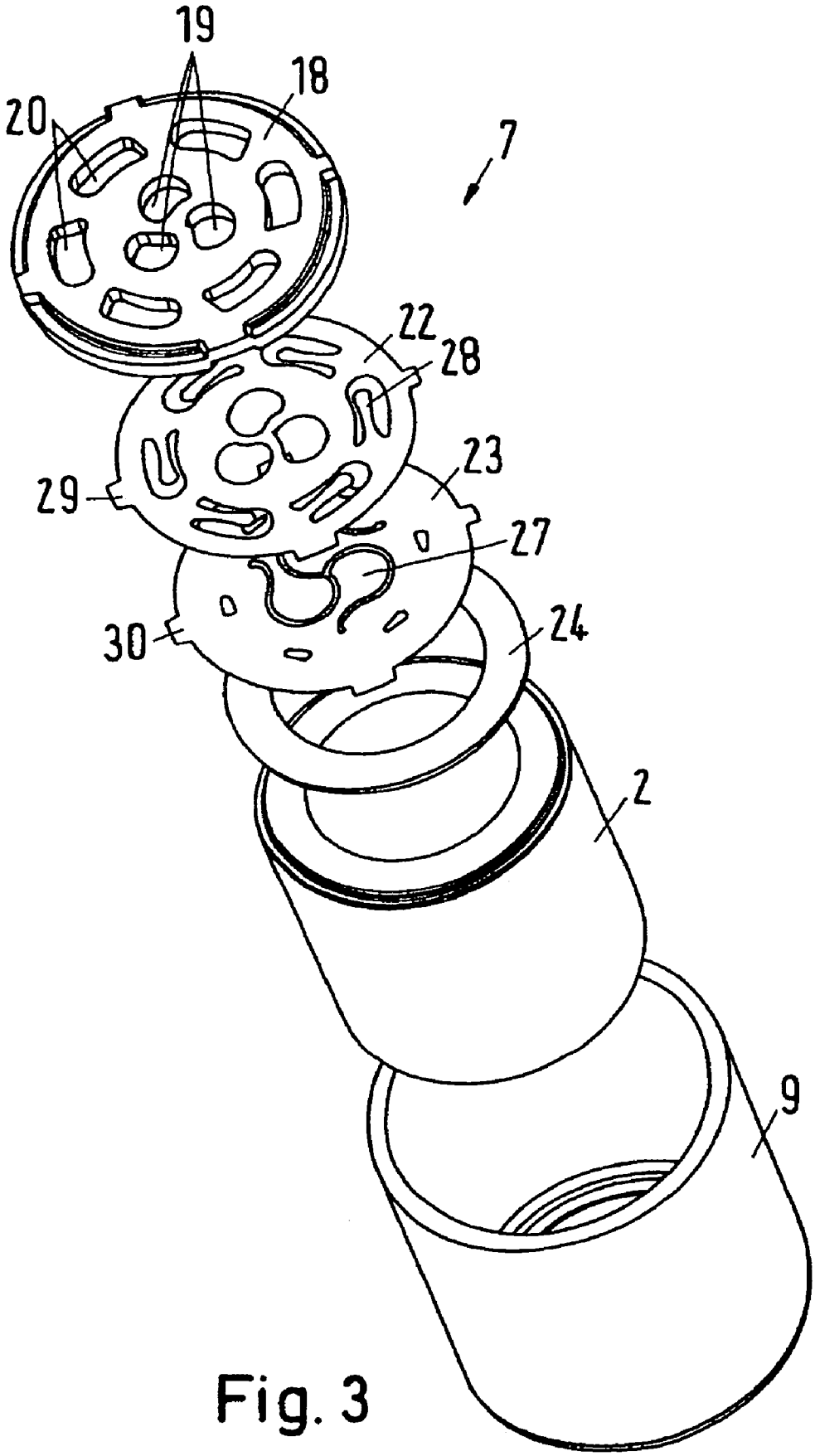
FIG. 3 is an exploded view of essential parts of the cylinder arrangement.

The design of the cylinder head arrangement 7 appears more clearly from FIG. 3. Here, it can be seen that the suction valve plate 23 has several suction valve elements 27, bearing in the closed state on valve seats, which are formed on the side of the pressure valve plate 22 facing the cylinder body 2. Thus, the pressure valve plate 22 forms valve seats for the suction valve elements 27. The pressure valve plate 22, however, has several pressure valve elements 28, bearing in the closed state on valve seats, which are formed on the suction valve plate 23.

The pressure valve plate 22 and the suction valve plate 23 have several radial projections 29, 30, which engage in gaps between the projections 21 of the base plate 18 in order to position the suction valve plate 23, the pressure valve plate 22 and the base plate 18 correctly in relation to each other.

On the side opposite the cylinder body 2 is located a pressure muffler 31, which has a bottom part 32 and a top part 33. Together, the bottom part 32 and the top part enclose a muffling volume 34. The bottom part 32 is connected with the base plate 18 by means of welding seams 35. The top part 33 is welded onto the bottom part by means of welding seams 36.

Expediently, the welding of the pressure muffler 31 onto the base plate 18 takes place after the mounting sleeve 9 has been connected with the base plate 18.

With the cylinder arrangement 1 shown, it can be ensured in a simple manner that the cylinder body 2 is not deformed by external forces, when the cylinder arrangement is mounted. During mounting, the mounting sleeve 9 can, for example, be welded or screwed together with any other components of the refrigerant compressor.

In the area of the cylinder head arrangement 7, the mounting sleeve 9 can also be fixed in a different manner, for example in that an edge is bent around the base plate 18. However, it should be observed that the base plate 18 is not too heavily deformed to avoid leakages in the suction and pressure valves.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A piston compressor cylinder arrangement for a hermetically enclosed refrigerant compressor, with a cylinder body and a cylinder head arrangement, the cylinder body having a first front side in the area of the cylinder head arrangement and a second front side at the other end, the cylinder body having a cylinder chamber extending from the first front side to the second front side, wherein a cup-shaped mounting sleeve surrounds the cylinder body over its full axial working length with a radial gap on all sides, the radial gap extending over the full axial working length of the cylinder body between the radial outside of the cylinder body and the radial inside of the mounting sleeve.

2. The piston compressor cylinder arrangement according to claim 1, wherein the radial gap has an extension, which as a maximum corresponds to the radial thickness of the cylinder body plus the radial thickness of the mounting sleeve.

3. The piston compressor cylinder arrangement according to claim 1, wherein a radially inwardly protruding end section of the mounting sleeve bears on the second front side of the cylinder body.

4. The piston compressor cylinder arrangement according to claim 3, wherein the end section is also deformed axially inwards.

5. The piston compressor cylinder arrangement according to claim 3, wherein the outside of the second cylinder body front side has a circumferential recess, in which the mounting sleeve end section engages.

6. The piston compressor cylinder arrangement according to claim 5, wherein the radial inside of the recess is bordered by a conically shaped wall.

7. The piston compressor cylinder arrangement according to claim 1, wherein the mounting sleeve is a deep-drawn sheet metal part.

8. The piston compressor cylinder arrangement according to claim 1, wherein the cylinder body is a sintered part.

9. The piston compressor cylinder arrangement according to claim 8, wherein the sintered part is treated to be gas-tight, particularly steam-cured.

10. The piston compressor cylinder arrangement according to claim 1, wherein the first cylinder body front side has a recess, into which a projection arrangement formed on the cylinder head arrangement engages.

11. The piston compressor cylinder arrangement according to claim 10, wherein the recess is made to be circumferential.

12. The piston compressor cylinder arrangement according to claim 10, wherein the projection arrangement has several circumferentially distributed projections, which are separated from each other by interstices.

13. The piston compressor cylinder arrangement according to claim 1, wherein the mounting sleeve is fixedly connected with the cylinder head arrangement.

14. The piston compressor cylinder arrangement according to claim 13, wherein the mounting sleeve is connected with a circumferential face of the cylinder head arrangement.

15. The piston compressor cylinder arrangement according to claim 1, wherein the cylinder head arrangement has a base plate, which has, on the side facing the cylinder body, a pressure valve plate and adjacently a suction valve plate, the pressure valve plate forming a valve seat for at least one suction valve and the suction valve plate forming a valve seat for at least one pressure valve.

16. The piston compressor cylinder arrangement according to claim 15, wherein a pressure muffler is located on the side of the base plate facing away from the cylinder body, the pressure muffler being connected with the base plate by means of welding.

17. The piston compressor cylinder arrangement according to claim 16, wherein the pressure muffler has a bottom part, which is welded onto the base plate and a top part, which is welded onto the bottom part.

18. The piston compressor cylinder arrangement according to claim 1, wherein the radial gap has an extension, which as a maximum corresponds to the radial thickness of the cylinder body.

19. The piston compressor cylinder arrangement according to claim 1, wherein the radial gap has an extension, which as a maximum corresponds to the radial thickness of the mounting sleeve.

20. A piston compressor cylinder arrangement for a hermetically enclosed refrigerant compressor comprising:

a cylinder head arrangement having a base plate;

a cylinder body having a first front side contacting the cylinder head arrangement and a second front side at the other end thereof; and a cup-shaped mounting sleeve surrounding the cylinder body-over its full axial working length with a circumferential radial gap therebetween, the radial gap extending over the full axial working length of the cylinder body between the radial outside of the cylinder body and the radial inside of the mounting sleeve; and wherein the cup-shaped mounting sleeve is fixedly connected to the base plate of the cylinder head arrangement.

21. A compressor sub-assembly for installation in a hermetically enclosed refrigerant compressor comprising:

a pre-manufactured cartridge unit including a cylinder head arrangement forming at least one suction valve and at least one pressure valve, a cylinder body having a first front side contacting the cylinder head arrangement and a second front side at the other end thereof, and a cup-shaped mounting sleeve surrounding the cylinder body over its full axial working length with a circumferential radial gap therebetween, the radial gap extending over the full axial working length of the cylinder body between the radial outside of the cylinder body and the radial inside of the mounting sleeve wherein the pre-manufactured cartridge unit may be handled as a single piece when mounting in the refrigerant compressor.

* * * * *